US008596757B2

(12) United States Patent
Koseki

(10) Patent No.: US 8,596,757 B2
(45) Date of Patent: Dec. 3, 2013

(54) LIQUID JET HEAD AND LIQUID JET APPARATUS INCORPORATING SAME

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/373,178

(22) Filed: Nov. 7, 2011

(65) Prior Publication Data

US 2012/0121797 A1 May 17, 2012

(30) Foreign Application Priority Data

Nov. 10, 2010 (JP) ..... 2010-251816

(51) Int. Cl.
*B41J 2/135* (2006.01)

(52) U.S. Cl.
USPC ..... 347/44

(58) Field of Classification Search
USPC ..... 347/44
See application file for complete search history.

(56) References Cited

U.S. PATENT DOCUMENTS

2010/0177133 A1 7/2010 Makishima ..... 347/10

FOREIGN PATENT DOCUMENTS

| | | |
|---|---|---|
| EP | 2130678 | 12/2009 |
| JP | 09029977 | 2/1997 |
| JP | 2002160365 | 6/2002 |
| WO | 03059627 | 7/2003 |

*Primary Examiner* — Matthew Luu
*Assistant Examiner* — Michael Konczal
(74) *Attorney, Agent, or Firm* — Adams & Wilks

(57) ABSTRACT

A liquid jet head includes an actuator substrate having grooves, and a flexible substrate for supplying a drive signal to the actuator substrate. On a surface of the actuator substrate, in the vicinity of a rear end thereof, are formed a common extension electrode and an individual extension electrode connected to drive electrodes of a discharge channel and dummy channels, respectively. The common extension electrode and the individual extension electrode are connected to a common wiring electrode and an individual wiring electrode of the flexible substrate, respectively. In a common wiring intersection region in which the common wiring electrode of the flexible substrate intersects the drive electrodes of the actuator substrate, upper end portions of the drive electrodes on side surfaces of the dummy channels are formed deeper than the substrate surface.

8 Claims, 10 Drawing Sheets

LIQUID JET HEAD AND LIQUID JET APPARATUS INCORPORATING SAME

BACKGROUND OF THE INVENTION

1. Field of the Invention

The present invention relates to a liquid jet head for discharging liquid from nozzles to form images and characters on a recording medium or form a thin film material, and also relates to a liquid jet apparatus using the liquid jet head.

2. Description of the Related Art

In recent years, an ink jet system liquid jet head has been used for creating characters and graphics by discharging ink droplets onto a recording sheet or the like, or forming a pattern of a functional thin film by discharging a liquid material onto a surface of an element substrate. In the ink jet system, ink or a liquid material is supplied from a liquid tank to the liquid jet head through a supply tube, and the ink is loaded into small spaces formed in the liquid jet head. In response to a drive signal, the volume of the small spaces is instantaneously reduced to discharge liquid droplets from nozzles communicating to grooves.

FIG. 12 is an exploded perspective view of an ink jet head 51 of this type. The ink jet head 51 includes a piezoelectric substrate 52 having a plurality of grooves 56 formed in a surface thereof, a cover plate 54 having a liquid supply cell 62 and slits 63 formed therein, a nozzle plate 55 provided with nozzles 64 for discharging liquid, and a flexible substrate 53 for supplying a drive signal generated by a drive circuit to the piezoelectric substrate 52. The grooves 56 have upper openings closed by the cover plate 54 to form channels. The grooves 56 are partitioned by partition walls 57, and on side surfaces of each partition wall 57, drive electrodes 59 for driving the partition wall 57 are formed. The drive electrodes 59 are connected to extension electrodes 60, which are formed on the surface of the piezoelectric substrate 52 at a rear end RE thereof. The partition walls 57 formed of a piezoelectric body are subjected to polarization processing in a perpendicular direction. By supplying the drive signal to the drive electrodes 59 formed on both the side surfaces of the partition wall 57, the partition wall 57 slips to be deformed in the thickness direction. By deforming the partition walls 57 at the time of driving under a state in which the channels formed by the grooves 56 are loaded with liquid in advance, the volume of the channels changes to discharge the ink from the nozzles 64 of the nozzle plate 55, which is bonded to a surface of the piezoelectric substrate 52 at a front end FE thereof.

FIG. 13 is a schematic top view of the piezoelectric substrate 52 and the flexible substrate 53 in a state in which the flexible substrate 53 bonded to the surface of the piezoelectric substrate 52 in the vicinity of the rear end RE is separated from the piezoelectric substrate 52 and displaced downward of the drawing sheet. The channels formed by the grooves are provided in the surface of the piezoelectric substrate 52, the channels including dummy channels D1 to Dn+1 and discharge channels C1 to Cn for discharging liquid droplets, which are arranged alternately with each other. The drive electrodes 59 for deformably driving each partition wall 57 partitioning the channels are formed on the side surfaces of the partition wall 57. The extension electrodes 60 electrically connected to the drive electrodes 59 of each channel are formed on the surface of the piezoelectric substrate 52 in the vicinity of the rear end RE. For example, drive electrodes 59*c*1 are formed on both side surfaces of both the partition walls 57 on the discharge channel side, the partition walls 57 constituting the discharge channel C1, and the drive electrodes 59*c*1 are connected to a first extension electrode 60*c*1.

A drive electrode 59*d*1 is formed on a side surface of the dummy channel D1 on the discharge channel C1 side, and a drive electrode 59*d*2 is formed on a side surface of the dummy channel D2 on the discharge channel C1 side. Both the drive electrode 59*d*1 and the drive electrode 59*d*2 are electrically connected to a second extension electrode 60*d*1. The other discharge channels C2 to Cn, the dummy channels D2 to Dn+1, and the first and second extension electrodes 60*c* and 60*d* have the same structures, respectively.

On a surface of the flexible substrate 53 on the piezoelectric substrate 52 side, there are formed wiring electrodes 61 for supplying the drive signal to the drive electrodes 59. As indicated by the arrows of FIG. 13, the flexible substrate 53 is moved to the surface of the piezoelectric substrate 52 on the rear end RE side so as to be bonded to the surface of the piezoelectric substrate 52, with a wiring electrode 61*d*1 electrically connected to the extension electrode 60*d*1; a wiring electrode 61*c*1, the extension electrode 60*c*1; and a wiring electrode 61*d*2, an extension electrode 60*d*2. The same applies to the other wiring electrodes 61.

FIG. 14 is a perspective view illustrating another ink jet head (FIG. 1 of Japanese Patent Application Laid-open No. Hei 9-29977). A plurality of grooves are formed in a lower surface of a piezoelectric ceramic substrate 71 to form channels. A nozzle plate (not shown) is bonded to a surface 74 of the piezoelectric ceramic substrate 71 at a front end portion thereof, and ink cells 72 formed by the grooves communicate to nozzles of the nozzle plate. Drive electrodes are formed on each partition wall partitioning the ink cells 72 provided in the lower surface, and the respective drive electrodes are extended by extension electrodes 76 to a surface 75 via the surface 74. On the surface 74, the electrodes are insulated from one another by insulating portions 73, while on the surface 75, the extension electrodes 76 are electrically insulated from one another by insulating portions 77. The extension electrodes 76 are connected to electric wires 79 at electric connection terminals 78 provided on the upper surface of the piezoelectric ceramic substrate 71 at a rear end thereof, and thereby connected to a drive circuit (not shown). In this example, a pitch W2 of the electric connection terminals 78 is set larger than a pitch W1 of the ink cells 72, to thereby facilitate connection to an external connection circuit.

In the conventional example illustrated in FIGS. 12 and 13, a pitch P1 of the connection points between the wiring electrodes 61 formed on the flexible substrate 53 and the extension electrodes 60 needs to be set substantially equal to an arrangement pitch P of the channels formed in the piezoelectric substrate 52. In recent years, however, the arrangement pitch P2 has become smaller and smaller with the increase in number of channels. Therefore, the pitch P1 of the connection points between the wiring electrodes 61 on the flexible substrate 53 and the extension electrodes 60 also needs to have a smaller pitch, which requires strict alignment accuracy at the time of alignment and mounting. As a result, there arises such a problem that the manufacturing becomes difficult or manufacturing yields decrease.

Further, in order to form the extension electrodes 76 on the back surface side of the piezoelectric ceramic substrate 71 as illustrated in FIG. 14, the electrode pattern needs to be formed on the surface 74 of the piezoelectric ceramic substrate 71 at the front end thereof and on the upper surface 75 thereof. Therefore, there arises such a problem that the manufacturing process becomes complex and accordingly mass productivity decreases.

SUMMARY OF THE INVENTION

The present invention has been made in view of the above-mentioned circumstances, and it is therefore an object of the present invention to provide a liquid jet head which can be easily constituted, a liquid jet apparatus, and a method of manufacturing a liquid jet head.

A liquid jet head according to the present invention includes: an actuator substrate including: a plurality of grooves, which are elongated in a direction from a front end of a substrate surface to a rear end thereof, and arranged in a direction intersecting the direction from the front end to the rear end while being spaced apart from one another through an intermediation of partition walls; drive electrodes, which are formed on side surfaces of each of the partition walls; and extension electrodes, which are electrically connected to the drive electrodes and formed on the substrate surface in the vicinity of the rear end; a cover plate, which is bonded to the substrate surface and closes upper openings of the plurality of grooves to form a plurality of channels; and a flexible substrate, which is bonded to the substrate surface in the vicinity of the rear end, and includes wiring electrodes electrically connected to the extension electrodes, in which the plurality of channels include: a discharge channel for discharging liquid; and a dummy channel that does not discharge the liquid, the discharge channel and the dummy channel being arranged alternately with each other, in which the plurality of grooves include a groove constituting the dummy channel, which extends to the rear end of the actuator substrate, in which the extension electrodes include: an individual extension electrode, which is formed on the substrate surface in the vicinity of the rear end between two dummy channels adjacent to both sides of the discharge channel, and electrically connected to drive electrodes formed on side surfaces of the two dummy channels on the discharge channel side; and a common extension electrode, which is formed on the substrate surface in the vicinity of the rear end and closer to the front end than the individual extension electrode, and electrically connected to drive electrodes formed on two side surfaces of the discharge channel, in which the wiring electrodes include: a common wiring electrode, which electrically connects the common extension electrode corresponding to the discharge channel, and another common extension electrode corresponding to another discharge channel; and a plurality of individual wiring electrodes, which are electrically and individually connected to the individual extension electrode corresponding to the discharge channel and another individual extension electrode corresponding to the another discharge channel, and in which, in a common wiring intersection region in which the common wiring electrode intersects the drive electrodes, upper end portions of drive electrodes formed on side surfaces of the groove constituting the dummy channel are formed deeper in a depth direction of the groove than the substrate surface.

Further, in the common wiring intersection region, corner portions between the substrate surface and the side surfaces of the groove constituting the dummy channel are cut in the depth direction.

Further, the plurality of grooves include a groove constituting the discharge channel, which extends from the front end of the actuator substrate to a position short of the rear end.

Further, the plurality of grooves include a groove constituting the discharge channel, which extends from the front end of the actuator substrate to the rear end thereof, the individual extension electrode includes: a first individual extension electrode, which is formed between the discharge channel and a dummy channel adjacent to one side of the discharge channel; and a second individual extension electrode, which is formed between the discharge channel and a dummy channel adjacent to another side of the discharge channel, the first individual extension electrode is electrically connected to a drive electrode formed on a side surface of the dummy channel adjacent to the one side of the discharge channel, the side surface being situated on the discharge channel side, and the second individual extension electrode is electrically connected to a drive electrode formed on a side surface of the dummy channel adjacent to the another side of the discharge channel, the side surface being situated on the discharge channel side, the common extension electrode includes: a first common extension electrode, which is formed between the discharge channel and the dummy channel adjacent to the one side of the discharge channel; and a second common extension electrode, which is formed between the discharge channel and the dummy channel adjacent to the another side of the discharge channel, the first common extension electrode is electrically connected to a drive electrode formed on one side surface of the groove constituting the discharge channel, and the second common extension electrode is electrically connected to a drive electrode formed on another side surface of the groove constituting the discharge channel, and the common wiring electrode electrically connects the first common extension electrode and the second common extension electrode that correspond to the discharge channel.

Further, one of the plurality of individual wiring electrodes electrically connects the first individual extension electrode and the second individual extension electrode that correspond to the discharge channel.

Further, in an individual wiring intersection region in which the plurality of individual wiring electrodes intersect the drive electrodes, upper end portions of the drive electrodes formed on the one side surface and the another side surface of the groove constituting the discharge channel are formed deeper in the depth direction of the groove than the substrate surface.

Further, in the individual wiring intersection region, corner portions between the substrate surface and the one side surface of the groove constituting the discharge channel and between the substrate surface and the another side surface of the groove constituting the discharge channel are cut in the depth direction.

A liquid jet apparatus according to the present invention includes: any one of the above-mentioned liquid jet heads; a moving mechanism for reciprocating the liquid jet head; a liquid supply tube for supplying liquid to the liquid jet head; and a liquid tank for supplying the liquid to the liquid supply tube.

A method of manufacturing a liquid jet head according to the present invention includes: a groove forming step of forming, in a substrate surface of an actuator substrate, a plurality of grooves spaced apart from one another through an intermediation of partition walls; an electrode depositing step of depositing an electrode material on side surfaces of the partition walls and upper surfaces of the partition walls; an electrode forming step of forming, on the side surfaces of the partition walls, drive electrodes shaped so that part of upper end portions thereof is lower in height than the upper surfaces in a depth direction of the plurality of grooves, and forming extension electrodes on the upper surfaces; and a flexible substrate bonding step of bonding a flexible substrate having wiring electrodes formed thereon to the upper surfaces of the partition walls to electrically connect the extension electrodes and the wiring electrodes to each other.

Further, the electrode forming step includes: a drive electrode forming step of forming the drive electrodes by removing part of electrodes deposited on upper end portions of the side surfaces; and an extension electrode forming step of forming the extension electrodes by patterning electrodes deposited on the upper surfaces of the partition walls.

Further, the drive electrode forming step includes chamfering corner portions between the upper surfaces and the side surfaces of the partition walls.

Further, the electrode forming step includes disposing, prior to the electrode depositing step, a mask on one of the upper surfaces of the partition walls and vicinity of the upper surfaces, and removing the mask subsequently to the electrode depositing step to form the drive electrodes and the extension electrodes.

The liquid jet head according to the present invention includes: the actuator substrate including: the plurality of grooves, which are elongated in the direction from the front end of the substrate surface to the rear end thereof, and arranged in the direction intersecting the direction from the front end to the rear end while being spaced apart from one another through an intermediation of the partition walls; the drive electrodes, which are formed on the side surfaces of each of the partition walls; and the extension electrodes, which are electrically connected to the drive electrodes and formed on the substrate surface in the vicinity of the rear end; the cover plate, which is bonded to the substrate surface and closes the upper openings of the plurality of grooves to form the plurality of channels; and the flexible substrate, which is bonded to the substrate surface in the vicinity of the rear end, and includes the wiring electrodes electrically connected to the extension electrodes. The plurality of channels include: the discharge channel for discharging liquid; and the dummy channel that does not discharge the liquid, the discharge channel and the dummy channel being arranged alternately with each other. The plurality of grooves include the groove constituting the dummy channel, which extends to the rear end of the actuator substrate. The extension electrodes include: the individual extension electrode, which is formed on the substrate surface in the vicinity of the rear end between two dummy channels adjacent to both sides of the discharge channel, and electrically connected to drive electrodes formed on side surfaces of the two dummy channels on the discharge channel side; and the common extension electrode, which is formed on the substrate surface in the vicinity of the rear end and closer to the front end than the individual extension electrode, and electrically connected to drive electrodes formed on two side surfaces of the discharge channel. The wiring electrodes include: the common wiring electrode, which electrically connects the common extension electrode corresponding to the discharge channel, and another common extension electrode corresponding to another discharge channel; and the plurality of individual wiring electrodes, which are electrically and individually connected to the individual extension electrode corresponding to the discharge channel and another individual extension electrode corresponding to the another discharge channel. In the common wiring intersection region in which the common wiring electrode of the flexible substrate intersects the drive electrodes, upper end portions of drive electrodes formed on side surfaces of the groove constituting the dummy channel are deeper in the depth direction of the groove than the substrate surface.

With this structure, the number of wiring electrodes on the flexible substrate can be reduced substantially by half as compared to the number of extension electrodes on the actuator substrate. In addition, at the intersection at which the wiring electrodes on the flexible substrate intersect, in plan view, the drive electrodes formed on the side surfaces of the partition walls, the clearances are provided between both the electrodes. Accordingly, the insulation properties of both the electrodes can be enhanced. As a result, electric connection between the extension electrodes on the actuator substrate and the wiring electrodes on the flexible substrate is facilitated, thereby enabling increase in manufacturing yields and reduction in manufacturing cost.

DETAILED DESCRIPTION OF THE PREFERRED EMBODIMENTS

<Liquid Jet Head>

(First Embodiment)

Figure 1:
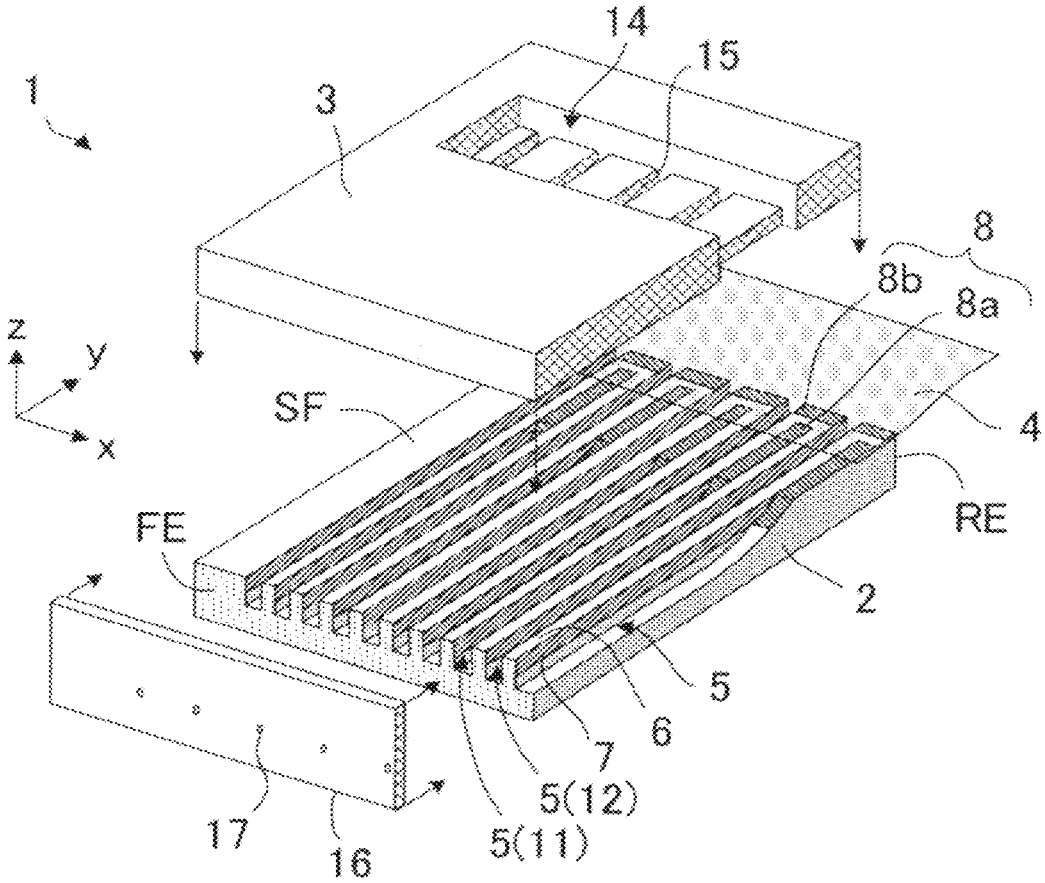
FIG. 1 is a schematic exploded perspective view of a liquid jet head according to a first embodiment of the present invention.
Figure 2A:
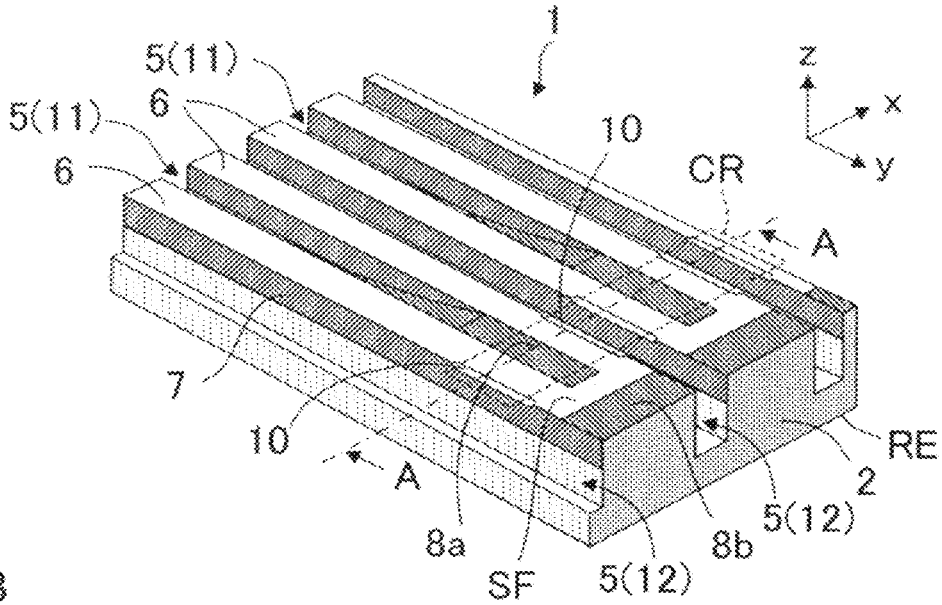
FIGS. 2A and 2B are explanatory views of an actuator substrate to be used for the liquid jet head according to the first embodiment of the present invention.
Figure 2B:
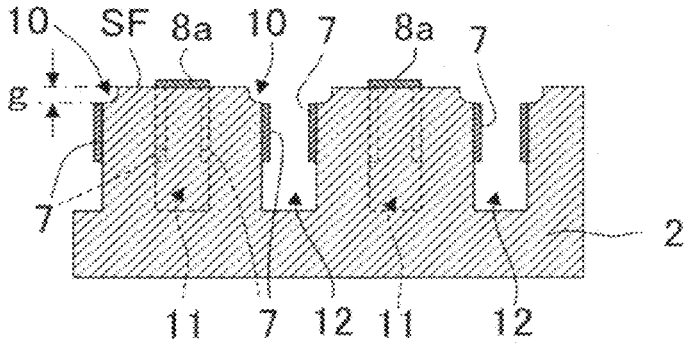
Figure 3A:
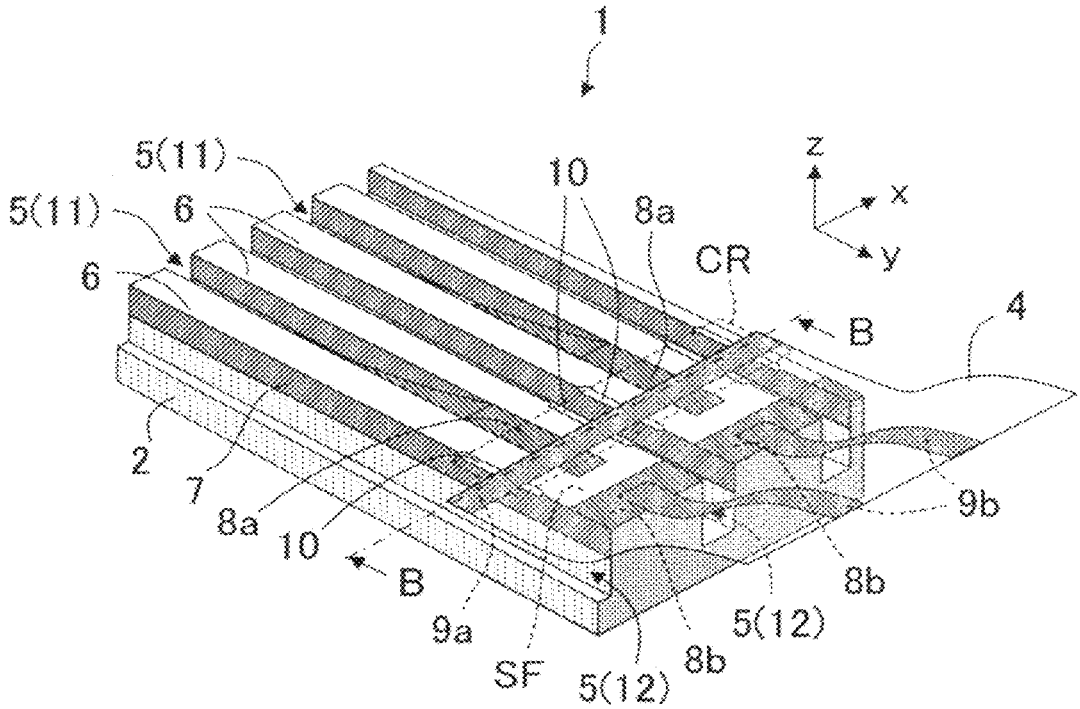
FIGS. 3A and 3B are views illustrating a state in which a flexible substrate is bonded to the actuator substrate of the liquid jet head according to the first embodiment of the present invention.
Figure 3B:
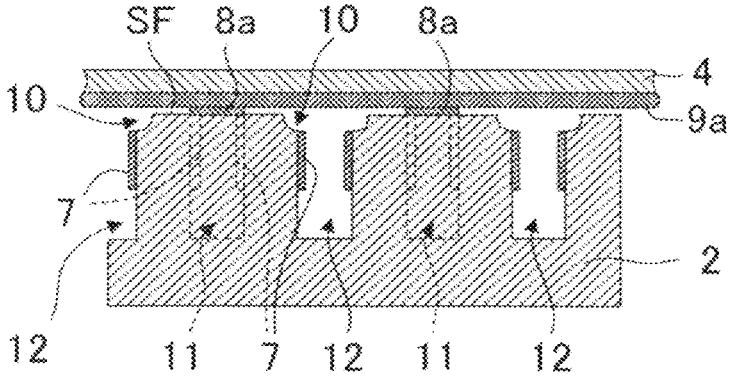

FIGS. 1 to 3B are explanatory views illustrating a liquid jet head 1 according to a first embodiment of the present invention. FIG. 1 is a schematic exploded perspective view of the liquid jet head 1. FIGS. 2A and 2B are explanatory views of an actuator substrate 2. FIGS. 3A and 3B are views illustrating a state in which a flexible substrate 4 is bonded to the actuator substrate 2.

As illustrated in FIG. 1, the liquid jet head 1 includes the actuator substrate 2, a cover plate 3, the flexible substrate 4, and a nozzle plate 16. The actuator substrate 2 includes: a plurality of grooves 5, which are elongated in a "y" direction, that is, a direction from a front end FE of a substrate surface SF to a rear end RE thereof, and arranged in an "x" direction intersecting the above-mentioned "y" direction while being spaced apart from one another through an intermediation of partition walls 6; drive electrodes 7, which are formed on side surfaces of each of the partition walls 6; and extension electrodes 8, which are electrically connected to the drive electrodes 7 and formed on the substrate surface SF in the vicinity of the rear end RE thereof. The cover plate 3 is bonded to the substrate surface SF and closes upper openings of the plurality of grooves 5 to form channels. The flexible substrate 4 is bonded to the substrate surface SF in the vicinity of the rear end RE, and includes wiring electrodes 9 (common wiring electrode 9*a* and individual wiring electrodes 9*b* illustrated in FIGS. 3A and 3B) electrically connected to the extension electrodes 8. The nozzle plate 16 includes nozzles 17, and is bonded to the actuator substrate 2 and the cover plate 3 at the front end FE thereof. The grooves 5 formed in the actuator substrate 2 include grooves 5 constituting discharge channels 11 for discharging liquid and grooves 5 constituting dummy channels 12 that do not discharge the liquid, which are arranged alternately with each other. The cover plate 3 includes a liquid supply cell 14, and the liquid supply cell 14 communicates to the grooves 5 for the discharge channels 11 through slits 15 formed in a bottom surface of the liquid supply cell 14. Specifically, the liquid supplied to the liquid supply cell 14 is allowed to flow in the discharge channels 11 through the slits 15, and is discharged from the nozzles 17.

FIG. 2A is a schematic partial perspective view of the actuator substrate 2 in the vicinity of the rear end RE, and FIG. 2B is a schematic vertical cross-sectional view taken along the line AA of FIG. 2A. The grooves 5 constituting the dummy channels 12 extend to the rear end RE of the actuator substrate 2, while the grooves 5 constituting the discharge channels 11 extend to a position short of the rear end RE of the actuator substrate 2. The dummy channels 12 and the discharge channels 11 are arranged alternately with each other, and the grooves 5 constituting the respective channels are spaced apart from one another through the intermediation of the partition walls 6. Each partition wall 6 includes the drive electrodes 7 formed on both the side surfaces thereof. Each drive electrode 7 is formed in an upper portion of the groove 5, which is defined above the point substantially half the largest depth of the groove 5. Individual extension electrodes 8*b* are each formed on the substrate surface SF in the vicinity of the rear end RE between two dummy channels 12 adjacent to both the sides of the corresponding discharge channel 11. Each individual extension electrode 8*b* is electrically connected to drive electrodes 7 of the two dummy channels 12 adjacent to both the sides of the corresponding discharge channel 11, the drive electrodes 7 being formed on the side surfaces of the respective partition walls 6 on the discharge channel 11 side. Common extension electrodes 8*a* are each formed on the substrate surface SF closer to the front end FE than the individual extension electrode 8*b*, and electrically connected to drive electrodes 7 formed on the two partition walls 6 constituting the corresponding discharge channel 11.

A common wiring intersection region CR refers to a region in which the common wiring electrode 9*a* of the flexible substrate 4 intersects the drive electrodes 7 of the dummy channels 12 (see FIG. 3A). In this region, chamfer portions 10 are formed at corner portions between the side surfaces of the dummy channels 12 and the substrate surface SF. In each chamfer portion 10, the upper end portion of the drive electrode 7 is lower in height than the substrate surface SF by a distance g in a depth direction of the groove 5. Specifically, after the grooves 5 are formed and the drive electrodes 7 are subsequently formed, the corner portions between the side surfaces of the grooves 5 and the upper surface are chamfered with a dicing blade. In this manner, the corner portions between the side surfaces of the grooves 5 and the substrate surface SF are cut together with the drive electrodes 7, with the result that the upper end portions of the drive electrodes 7 become deeper in the depth direction than the substrate surface SF.

FIG. 3A is a schematic partial perspective view of the liquid jet head 1 in a state in which the flexible substrate 4 is bonded to the substrate surface SF of the actuator substrate 2 at the rear end RE. FIG. 3B is a schematic vertical cross-sectional view taken along the line BB of FIG. 3A. The flexible substrate 4 includes the common wiring electrode 9*a* and the plurality of individual wiring electrodes 9*b*, which are formed on the surface of the flexible substrate 4 on the actuator substrate 2 side. The common wiring electrode 9*a* is electrically connected to the respective common extension electrodes 8*a* in the common wiring intersection region CR, while the respective individual wiring electrodes 9*b* are electrically connected to the corresponding individual extension electrodes 8*b*. In other words, the plurality of common extension electrodes 8*a* are connected to the single common wiring electrode 9*a*, and hence the number of wiring electrodes on the flexible substrate 4 is reduced substantially by half. Further, each individual extension electrode 8*b* has a length in the "x" direction, which is a sum of the width of one discharge channel 11 and the thickness of two partition walls 6, and hence the strictness with the alignment accuracy required in aligning the individual wiring electrodes 9*b* to the individual extension electrodes 8*b* is greatly eased. Because the chamfer portions 10 are formed in the common wiring intersection region CR in which the common wiring electrode 9*a* intersects the drive electrodes 7, the common wiring electrode 9*a* is electrically insulated from the drive electrodes 7.

Note that, in the first embodiment, a lead zirconate titanate (PZT) ceramic substrate is used as the actuator substrate 2, and is subjected in advance to polarization processing in a direction perpendicular to the substrate surface. The distance from the front end FE to the rear end RE of the actuator substrate 2 is substantially 11 mm. The width of each groove 5 ranges from 70 μm to 80 μm. The depth of each groove 5 ranges from 300 μm to 500 μm. The length of each chamfer portion 10 is substantially 2.5 mm. The distance g ranges from 20 μm to 30 μm.

The liquid jet head 1 operates in the following manner. First, the liquid such as ink is supplied to the liquid supply cell 14, to thereby load the liquid into the discharge channels 11 through the slits 15. A drive circuit (not shown) generates a drive signal, and the drive signal is supplied to the respective individual wiring electrodes 9*b* with the common wiring electrode 9*a* of the flexible substrate 4 set as a GND. The drive signal is transmitted from the individual extension electrodes 8*b* to the drive electrodes 7 of the dummy channels 12 on the discharge channel 11 side, while the GND potential is transmitted from the common wiring electrode 9*a* to the common extension electrodes 8*a*, and transmitted to the drive electrodes 7 on the two side walls of the discharge channels 11. As a result, the two partition walls 6 constituting the discharge channel 11 slip to be deformed in the thickness direction by an electric field applied in the thickness direction, and the volume of the discharge channel 11 changes to discharge the liquid loaded inside from the nozzle (not shown).

In this manner, the common wiring electrode 9*a* formed on the flexible substrate 4 is electrically connected in common to the respective common extension electrodes 8*a* corresponding to the respective discharge channels 11, with the result that the number of wiring electrodes on the flexible substrate 4 is reduced substantially by half and the pitch of the wiring electrodes is substantially doubled. Accordingly, the positional alignment in the "x" direction between the common extension electrodes 8*a* and the common wiring electrode 9*a* is substantially unnecessary, and the strictness with the alignment accuracy in the "x" direction between the individual extension electrodes 8*b* and the individual wiring electrodes 9*b* is eased substantially by half as compared to the conventional method. Further, in the common wiring intersection region CR, the upper end portions of the drive electrodes 7 formed on the side surfaces of the dummy channels 12 are formed deeper in the depth direction than the substrate surface SF, and hence the insulation properties between the common wiring electrode 9*a* and the drive electrodes 7 are enhanced. As a result, the flexible substrate 4 is easily bonded to the substrate surface of the actuator substrate 2, thereby enabling increase in manufacturing yields and reduction in manufacturing cost.

Note that, the description is given of the structure in which the nozzle plate 16 is bonded to the actuator substrate 2 at the front end FE to discharge liquid droplets in a "−y" direction, but the present invention is not limited to this structure. For example, the following structure may be employed to discharge the liquid droplets in a "−z" direction. Opening portions are formed in bottom surfaces of the grooves 5 constituting the discharge channels 11, and the nozzle plate 16 is arranged on the actuator substrate 2 on a back surface side thereof. Then, the nozzles 17 to be formed in the nozzle plate 16 are adapted to communicate to the above-mentioned opening portions. Further, the cross-sectional shape of the chamfer portions 10 in the "x" direction may be a rectangular shape or an oblique shape as well as the arc shape.

Further, the chamfer portions 10 are formed and thus the upper end portions of the drive electrodes 7 are formed lower in height than the substrate surface SF (deeper in the depth direction of the grooves), but the present invention is not limited thereto. For example, only the upper end portions of the drive electrodes 7 in the common wiring intersection region CR may be removed by a laser beam or photolithography and an etching method, while upper end corner portions of the partition walls 6 are left. Further, the above-mentioned embodiment describes the structure in which after the drive electrodes 7 are formed, only the upper end portions of the drive electrodes 7 of the dummy channels 12 are removed in the common wiring intersection region CR, but the present invention is not limited to this structure. That is, before the drive electrodes 7 are formed, the upper end portions of the side surfaces of the dummy channels 12 may be masked in the common wiring intersection region CR of the dummy channels 12, to thereby realize this embodiment. Specifically, the upper end portions of the side surfaces of the dummy channels 12 are masked and then an electrode material is deposited to form the drive electrodes 7. After that, the mask is removed. In this manner, the common wiring electrode 9*a* is not brought into contact with the drive electrodes 7 of the dummy channels 12 in the common wiring intersection region CR. That is, the upper end portions of the drive electrodes 7 only need to be formed deeper in the depth direction than the position of the substrate surface SF so that the common wiring electrode 9*a* and the drive electrodes 7 are not electrically short-circuited when the flexible substrate 4 is bonded to the actuator substrate 2.

(Second Embodiment)

Figure 4:
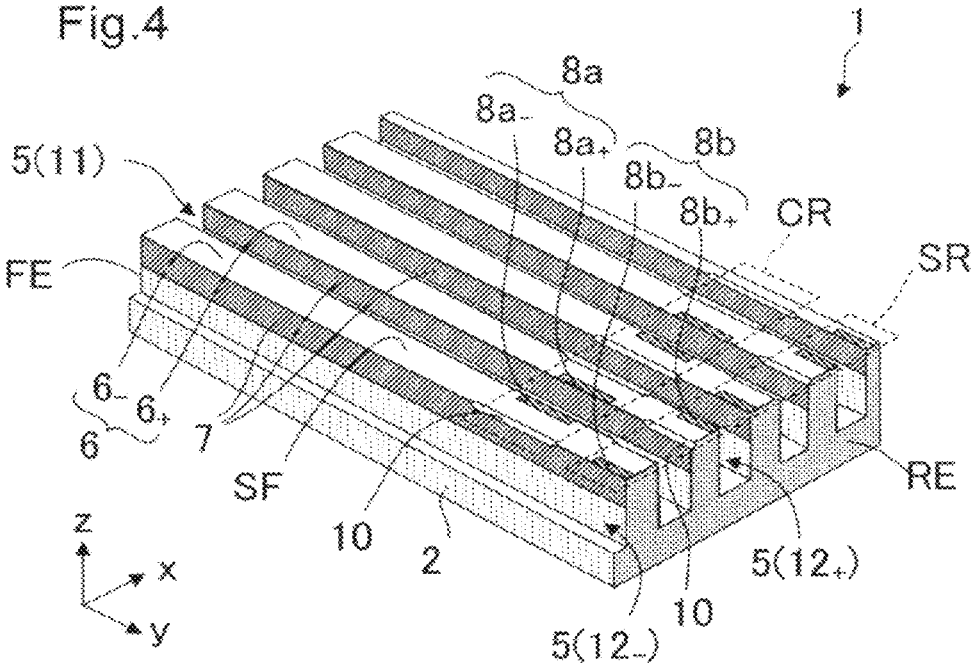
FIG. 4 is a schematic partial perspective view of an actuator substrate to be used for a liquid jet head according to a second embodiment of the present invention.

FIG. 4 is a schematic partial perspective view illustrating an actuator substrate 2 of a liquid jet head 1 on a rear end RE side according to a second embodiment of the present invention. The second embodiment is different from the first embodiment in that the grooves 5 constituting the discharge channels 11 extend to the rear end RE, and the common extension electrode 8*a* and the individual extension electrode 8*b* corresponding to one discharge channel 11 are separated on the upper surfaces of the two partition walls 6 situated on both the sides of the discharge channel 11.

The liquid jet head 1 includes the actuator substrate 2, a cover plate (not shown) bonded onto the actuator substrate 2, a flexible substrate 4 (see FIG. 5) bonded to the substrate surface of the actuator substrate 2 in the vicinity of the rear end RE, and a nozzle plate (not shown) bonded to the actuator substrate 2 and the cover plate at a front end FE thereof. The structures of the cover plate and the nozzle plate are the same as those of the first embodiment, and description thereof is therefore omitted herein.

As illustrated in FIG. 4, the actuator substrate 2 includes a plurality of grooves 5, which are elongated in a "y" direction, that is, a direction from the front end FE of a substrate surface SF to the rear end RE thereof, and arranged in an "x" direction intersecting the above-mentioned "y" direction while being spaced apart from one another through an intermediation of partition walls 6. The grooves 5 constituting discharge channels 11 extend from the front end FE to the rear end RE, and the grooves 5 constituting dummy channels 12 also extend from the front end FE to the rear end RE, which are arranged alternately with each other in the "x" direction. Each partition wall 6 includes drive electrodes 7 formed in upper portions of both the side surfaces thereof, which are defined above the point substantially half the height of the partition wall 6. Each drive electrode 7 extends from the front end FE of the actuator substrate 2 to the rear end RE thereof.

On one side of each discharge channel 11 ("−x" direction), a partition wall 6_ is arranged, while on the other side of the discharge channel 11 ("+x" direction), a partition wall $\mathbf{6}_+$ is arranged. The drive electrodes 7 are formed on the upper half of the side surfaces of both the partition walls 6_ and $\mathbf{6}_+$. An individual wiring intersection region SR is set on the substrate surface SF of the actuator substrate 2 in the vicinity of the rear end RE, while a common wiring intersection region CR is set on the substrate surface SF closer to the front end FE than the individual wiring intersection region SR. The individual wiring intersection region SR refers to a region in which the drive electrodes 7 formed on the side surfaces of the discharge channels 11 intersect, in plan view, individual wiring electrodes 9*b* formed on the flexible substrate 4 when the flexible substrate 4 is bonded to the actuator substrate 2. The common wiring intersection region CR refers to a region in which the drive electrodes 7 formed on the side surfaces of the dummy channels 12 intersect, in plan view, a common wiring electrode 9*a* formed on the flexible substrate 4 when the flexible substrate 4 is bonded to the actuator substrate 2.

As illustrated in FIG. 4, the partition wall 6_ includes an individual extension electrode 8*b*_ on the upper surface thereof, that is, the substrate surface SF, on the "−x" side in the individual wiring intersection region SR, and includes a common extension electrode 8*a*_ on the substrate surface SF on the "+x" side in the common wiring intersection region CR. The individual extension electrode 8*b*_ is electrically connected to the drive electrode 7 of the partition wall 6_ formed in a dummy channel 12_, while the common extension electrode 8*a*_ is electrically connected to the drive electrode (not shown) of the partition wall 6_ on the discharge channel 11 side. Similarly, the partition wall $\mathbf{6}_+$ includes an individual extension electrode $\mathbf{8}b_+$ on the upper surface thereof, that is, the substrate surface SF, on the "+x" side in the individual wiring intersection region SR, and includes a common extension electrode $\mathbf{8}a_+$ on the substrate surface SF on the "−x" side in the common wiring intersection region CR. The individual extension electrode $\mathbf{8}b_+$ is electrically connected to the drive electrode (not shown) of the partition wall $6_+$ formed on a dummy channel $12_+$ side, while the common extension electrode $8a_+$ is electrically connected to the drive electrode 7 of the partition wall $6_+$ on the discharge channel 11 side. The other discharge channels and dummy channels have the same structures, respectively.

Further, in the common wiring intersection region CR, chamfer portions 10 are provided at corner portions between the substrate surface SF and the side surfaces of the partition walls $6_-$ and $6_+$ (that is, side surfaces of the grooves 5) respectively constituting the dummy channels $12_-$ and $12_+$. The chamfer portions 10 are formed and thus the upper end portions of the drive electrodes 7 formed on the side surfaces are lower in height than the substrate surface SF in the depth direction of the grooves 5. Similarly, in the individual wiring intersection region SR, the chamfer portions 10 are provided at corner portions between the substrate surface SF and both the side surfaces of the grooves 5 constituting the discharge channels 11. Due to the chamfer portions 10, the upper end portions of the drive electrodes 7 formed on the side surfaces are lower in height than the substrate surface SF in the depth direction of the grooves 5. The other discharge channels and dummy channels have the same structures, respectively.

Figure 5:
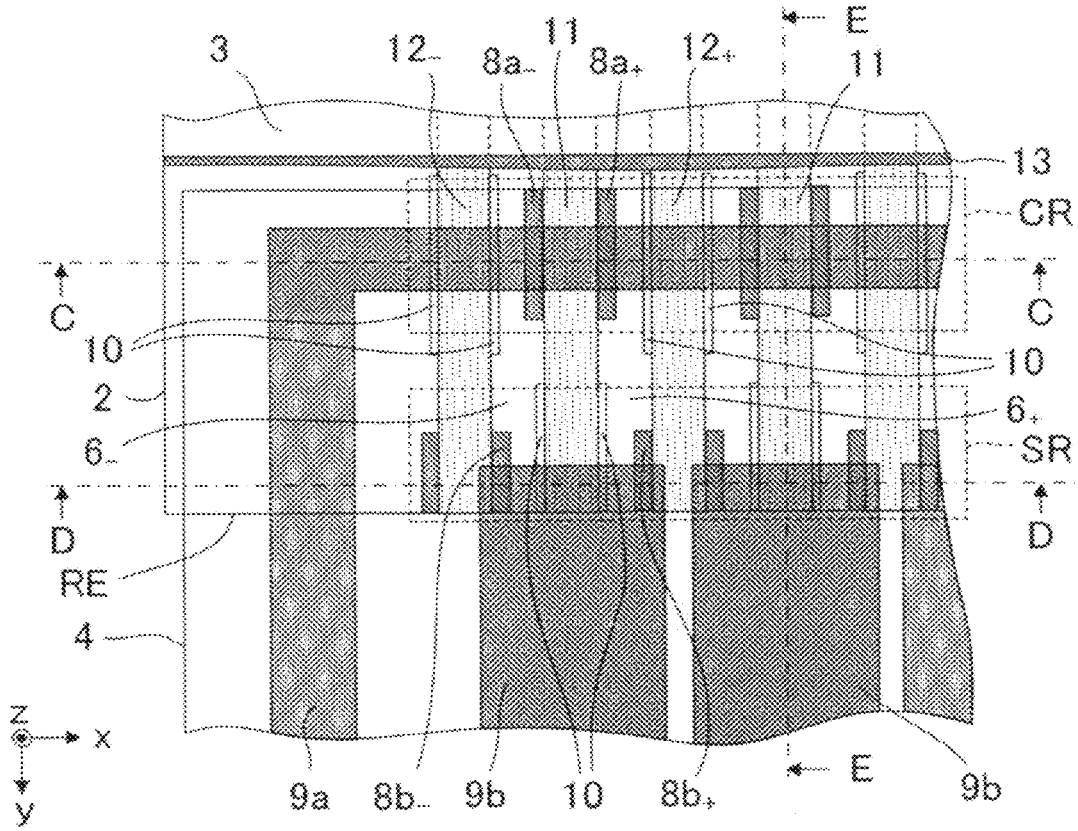
FIG. 5 is a schematic partial top view of the liquid jet head according to the second embodiment of the present invention.

FIG. 5 is a schematic partial top view of the liquid jet head 1, and illustrates a corner portion of the actuator substrate 2 in the vicinity of the rear end RE. The cover plate 3 is bonded onto the actuator substrate 2. A sealing material 13 is disposed at an end portion of the cover plate 3 on the rear end RE side to seal the grooves 5 constituting the discharge channels 11, and accordingly the liquid loaded into the discharge channels 11 is prevented from leaking to the rear end RE side. The flexible substrate 4 is bonded to the substrate surface SF which ranges from the rear end RE of the actuator substrate 2 to a position short of the sealing material 13. Regarding the sealing material 13, referring to FIG. 5, the sealing material 13 is formed over the range from the "−x" direction to the "+x" direction, but alternatively, the following structure may be employed. The sealing material 13 is formed only in the discharge channels 11 to which the ink is to be loaded to seal the discharge channels 11 on the rear end RE side.

The actuator substrate 2 includes the discharge channels 11, the dummy channels $12_-$ and $12_+$, and the partition walls $6_-$ and $6_+$ in the substrate surface of the actuator substrate 2. The actuator substrate 2 includes the common extension electrodes $8a_-$ and $8a_+$, and the individual extension electrodes $8b_-$ and $8b_+$ on the upper surfaces of the partition walls $6_-$ and $6_+$ (that is, the substrate surface SF of the actuator substrate 2), respectively. Those components are arranged in the same manner as in FIG. 4. The flexible substrate 4 includes the common wiring electrode 9*a* along an outer periphery of the surface of the flexible substrate 4 on the actuator substrate 2 side, and includes the plurality of individual wiring electrodes 9*b* on the inner side of the common wiring electrode 9*a*. The common wiring intersection region CR refers to a region in which the common wiring electrode 9*a* of the flexible substrate 4 intersects the drive electrodes 7 formed on both the side surfaces of the dummy channels $12_-$ and $12_+$, and the like. The individual wiring intersection region SR refers to a region in which the individual wiring electrodes 9*b* of the flexible substrate 4 intersect the drive electrodes 7 formed on both the side surfaces of the discharge channels 11. The chamfer portions 10 formed in the common wiring intersection region CR and the individual wiring intersection region SR are the same as those described with reference to FIG. 4.

The flexible substrate 4 is bonded to the substrate surface SF of the actuator substrate 2 in a region at the rear end RE through the intermediation of an anisotropic conductive film (not shown). In this manner, the common wiring electrode 9*a* is electrically connected to the common extension electrode $8a_-$ arranged on the partition wall $6_-$, the common extension electrode $8a_+$ arranged on the partition wall $6_+$, and the other common extension electrodes 8*a* arranged on the other partition walls 6. Further, each individual wiring electrode 9*b* electrically connects the individual extension electrode $8b_-$ arranged on the partition wall $6_-$ and the individual extension electrode $8b_+$ arranged on the partition wall $6_+$, which are situated on both sides of the corresponding discharge channel 11 across the discharge channel 11. The same applies to the other discharge channels 11.

Figure 6A:
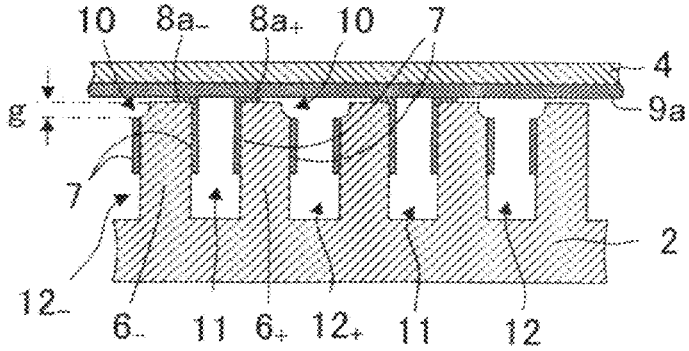
FIGS. 6A and 6B are schematic partial vertical cross-sectional views of the liquid jet head according to the second embodiment of the present invention.
Figure 6B:
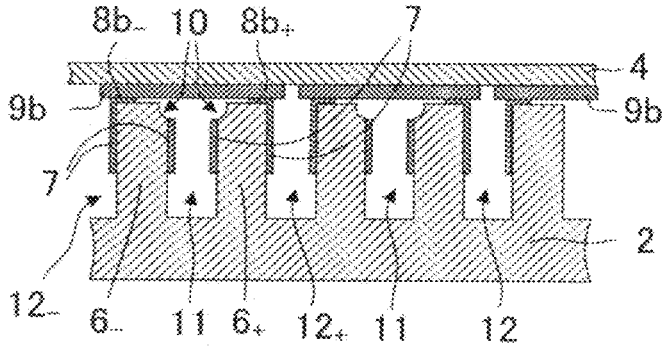

FIG. 6A partially illustrates a vertical cross section taken along the line CC of FIG. 5, and FIG. 6B partially illustrates a vertical cross section taken along the line DD of FIG. 5. Description is given with reference to FIG. 6A. The first common extension electrode $8a_-$ formed on the upper surface of the partition wall $6_-$ situated on one side of the corresponding discharge channel 11, and the second common extension electrode $8a_+$ formed on the upper surface of the partition wall $6_+$ situated on the other side are electrically connected to the common wiring electrode 9*a* of the flexible substrate 4. Both the first and second common extension electrodes $8a_-$ and $8a_+$ of the other discharge channels 11 are electrically connected to the same common wiring electrode 9*a*. Further, in the common wiring intersection region CR, the chamfer portion 10 is formed at the corner portion between the side surface and the upper surface of the partition wall $6_-$ in the dummy channel $12_-$, which is situated on one side of the corresponding discharge channel 11. Further, a distance g is provided between the upper end portion of the drive electrode 7 and the position of the substrate surface SF. In this manner, the drive electrode 7 is electrically insulated from the common wiring electrode 9*a*. The other dummy channels 12 have the same structure.

Description is given with reference to FIG. 6B. The first individual extension electrode $8b_-$ formed on the upper surface of the partition wall $6_-$ situated on one side of the corresponding discharge channel 11, and the second individual extension electrode $8b_+$ formed on the upper surface of the partition wall $6_+$ situated on the other side of the corresponding discharge channel 11 are both electrically connected to the individual wiring electrode 9*b* of the flexible substrate 4. The first and second individual extension electrodes $8h_-$ and $8b_+$ of the other discharge channels have the same structures, respectively. Further, in the individual wiring intersection region SR, the chamfer portions 10 are formed at the corner portions between the side surfaces and the upper surfaces of both the partition walls $6_-$ and $6_+$ constituting the corresponding discharge channel 11. Further, the distance g is provided between the upper end portions of the drive electrodes 7 and the position of the substrate surface SF. In this manner, the drive electrodes 7 are electrically insulated from the individual wiring electrodes 9*b*.

Figure 7:
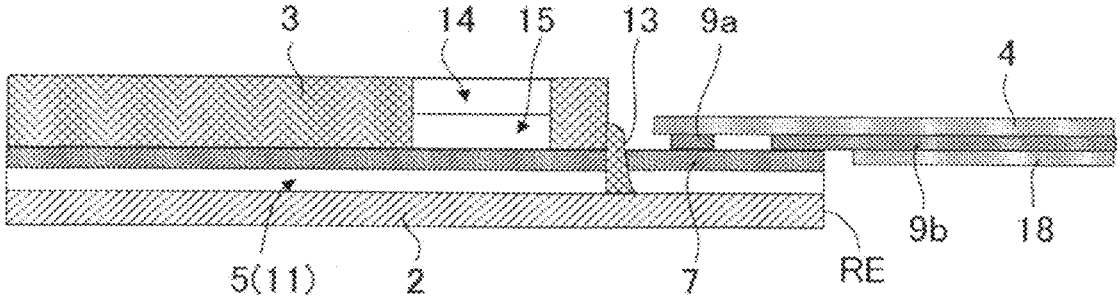
FIG. 7 is a schematic vertical cross-sectional view of the liquid jet head according to the second embodiment of the present invention.

FIG. 7 is a schematic vertical cross-sectional view taken along the line EE of FIG. 5. The cover plate 3 is bonded onto the actuator substrate 2, and the grooves 5 formed in the actuator substrate 2 and the cover plate 3 constitute the discharge channels 11. The sealing material 13 is molded at the end portion of the cover plate 3 on the rear end RE side to prevent the liquid loaded into the discharge channels 11 from leaking to the rear side. The flexible substrate 4 is bonded to the substrate surface of the actuator substrate 2 in the vicinity of the rear end RE. The common wiring electrode 9*a* and the plurality of individual wiring electrodes 9*b* are arranged on the surface of the flexible substrate 4, and electrically connected to the common extension electrodes (not shown) and the individual extension electrodes (not shown) through the anisotropic conductive film (not shown), respectively, the common extension electrodes and the individual extension electrodes being formed on the substrate surface of the actuator substrate 2 in the vicinity of the rear end RE.

The liquid such as ink supplied to the liquid supply cell 14 is loaded into the discharge channels 11 through the slits 15. When the drive signal is supplied from the drive circuit (not shown) to the respective individual wiring electrodes 9*b*, the drive signal is supplied through the individual extension electrodes 8*b* to the drive electrodes 7 formed on the side surfaces of the dummy channels 12 on the discharge channel 11 side. Meanwhile, the common wiring electrode 9*a* is connected to the GND, and the common extension electrodes connected to the common wiring electrode 9*a* are also connected to the GND. Accordingly, the drive electrodes formed on both the side surfaces of each discharge channel 11 are also connected to the GND. When the drive signal is supplied to both the partition walls of each discharge channel 11, the partition walls polarized in the perpendicular direction slip to be deformed in the thickness direction, and therefore the volume of the discharge channel 11 changes. In this manner, the liquid is discharged from the nozzle (not shown) communicating to the discharge channel 11. Note that, the liquid jet head 1 of the present invention has the structure in which the drive electrodes 7 are brought into contact with the liquid, but the drive electrodes 7 formed on the side surfaces of each discharge channel 11 are all connected to the GND. Accordingly, the drive signal does not leak through the liquid even in a case where the liquid is conductive. Further, a protection member 18 is arranged on the surface of the wiring electrodes 9 to prevent degradation of the wiring electrodes 9.

In this embodiment, the grooves 5 constituting the discharge channels 11 and the grooves 5 constituting the dummy channels 12 are formed straight over the range from the front end FE to the rear end RE, and thus it is possible to reduce the length of the actuator substrate 2 ranging from the front end FE to the rear end RE. Specifically, the grooves are formed with a disc-like dicing blade, and hence the arc shape of the dicing blade is transferred in the case where the grooves are formed toward any midpoint of the substrate surface of the actuator substrate 2 as in the first embodiment. Therefore, it is necessary to keep a distance from the end portions of the grooves in the substrate surface so as to ensure a predetermined depth of the grooves. This embodiment, however, does not require such a distance, and accordingly the liquid jet head can be downsized.

Further, as compared to the conventional example, the number of wiring electrodes on the flexible substrate 4 is reduced substantially by half and the wiring pitch is substantially doubled. Accordingly, the strictness with the alignment accuracy required in aligning the extension electrodes on the actuator substrate 2 to the wiring electrodes on the flexible substrate 4 is eased, and thus the connection is facilitated. Further, the wiring pitch may be reduced, and hence the liquid jet head of the present invention is suitable for channel arrangement with higher density. Further, in the common wiring intersection region CR and the individual wiring intersection region SR, the upper end portions of the drive electrodes 7 are formed deeper in the depth direction of the grooves than the height of the substrate surface SF, and thus the insulation properties between the drive electrodes 7 and the common wiring electrode 9*a* and between the drive electrodes 7 and the individual wiring electrodes 9*b* are enhanced. Accordingly, there is no need for a measure to insulate the wiring electrodes 9 from the drive electrodes 7, or even if necessary, a simple method may suffice therefor. Thus, the flexible substrate 4 can be bonded to the actuator substrate 2 highly easily.

Note that, in the above-mentioned first and second embodiments, the chamfer portions 10 are formed and thus the upper end portions of the drive electrodes 7 are formed deeper in the depth direction of the grooves than the position of the substrate surface SF, but the present invention is not limited to this structure. For example, only the upper end portions of the drive electrodes 7 in the common wiring intersection region CR and the individual wiring intersection region SR may be removed by a laser beam or photolithography and an etching method, while the upper end corner portions of the partition walls 6 are left. Instead of using the removal step of removing the upper end portions of the drive electrodes 7, the following method may be employed. A mask is disposed on the upper end portions of the side surfaces of the partition walls 6, and an electrode material is deposited from above the mask. After that, the mask is removed, and the drive electrodes 7 each having the upper end portion that is lower on the bottom surface side (deeper in the depth direction) of the groove than the position of the substrate surface SF are formed. Also in this case, the upper end corner portions of the partition walls 6 are left.

<Method of Manufacturing Liquid Jet Head>

Figure 8:
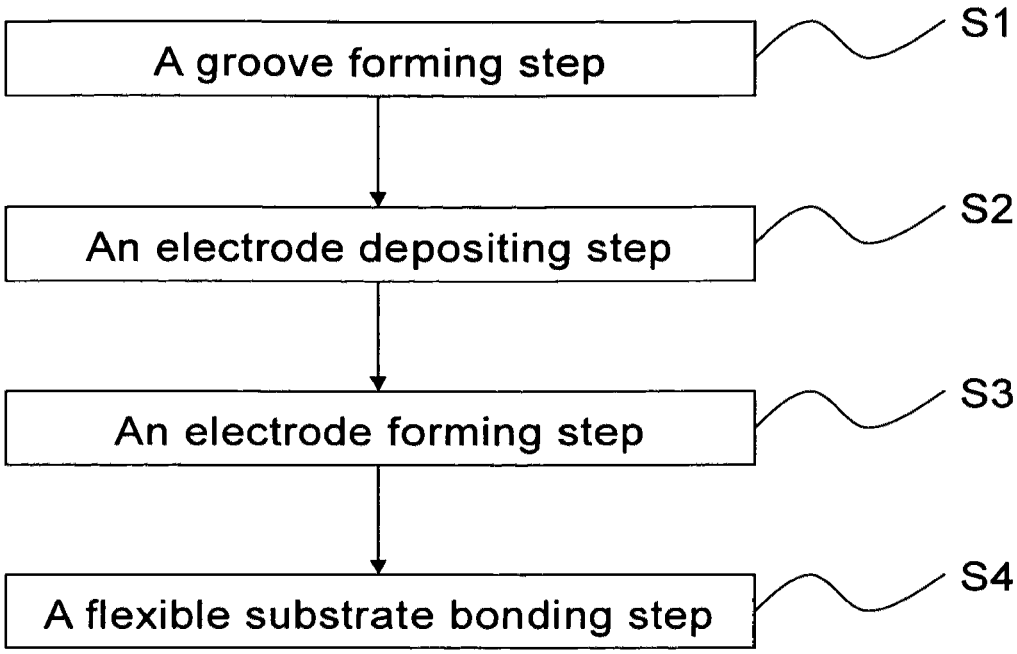
FIG. 8 is a flowchart illustrating a basic method of manufacturing a liquid jet head according to the present invention.

FIG. 8 is a flow chart illustrating a basic method of manufacturing the liquid jet head 1 according to the present invention.

First, in a groove forming step S1, an actuator substrate obtained by bonding a piezoelectric body onto a piezoelectric substrate or an insulating substrate is prepared, and a plurality of grooves spaced apart from one another through the intermediation of partition walls are formed in a substrate surface of the actuator substrate. The plurality of grooves may be formed by photolithography and an etching method, a sandblasting method, or by a cutting method using a dicing blade. Subsequently, in an electrode depositing step S2, an electrode material is deposited on side surfaces of the partition walls and upper surfaces of the partition walls. A conductor such as a metal may be deposited by a sputtering method, a vacuum deposition method, or a plating method. Subsequently, in an electrode forming step S3, there are formed, on the side surfaces of the partition walls, drive electrodes shaped so that part of upper end portions thereof is lower in height than the upper surfaces of the partition walls in the depth direction of the grooves. Further, extension electrodes are formed on the upper surfaces of the partition walls. The extension electrodes are electrically connected to the drive electrodes formed on the side surfaces of the partition walls, and function as terminal electrodes for electrically connecting to wiring electrodes formed on a flexible substrate or the like. Subsequently, in a flexible substrate bonding step S4, the flexible substrate having the wiring electrodes formed thereon is bonded to the upper surfaces of the partition walls of the actuator substrate, to thereby electrically connect the wiring electrodes and the extension electrodes to each other. The region in which part of the upper end portions of the drive electrodes is formed lower in height than the upper surfaces of the partition walls in the depth direction of the grooves refers to a region in which the wiring electrodes formed on the flexible substrate intersect, in plan view, the drive electrodes formed on the side surfaces of the partition walls when the flexible substrate is later bonded to the upper surfaces of the partition walls in the vicinity of the rear end portion of the actuator substrate.

The electrode forming step S3 may include: a drive electrode forming step S5 of forming the drive electrodes by removing part of the electrodes deposited on the side surfaces of the partition walls; and an extension electrode forming step S6 of forming the extension electrodes by patterning the electrodes deposited on the upper surfaces of the partition walls. In this case, the drive electrode forming step S5 and the extension electrode forming step S6 may be carried out independently of each other. As the drive electrode forming step S5, for example, after the electrode depositing step S2, a dicing blade is used to chamfer the corner portions between the side surfaces and the upper surfaces of the partition walls, to thereby remove the upper end portions of the electrodes deposited on the side surfaces of the partition walls in the depth direction of the grooves. Further, laser light is applied and accordingly the electrodes in the upper end portions of the side surfaces are evaporated and removed. Further, the electrodes in the upper end portions of the side surfaces of the partition walls are removed by photolithography and an etching method. Further, the drive electrode forming step S5 and the extension electrode forming step S6 may be carried out at the same time. For example, prior to the electrode depositing step S2, a mask is disposed on the upper end portions of the side surfaces of the partition walls and the upper surfaces of the partition walls, and then, in the electrode depositing step S2, the electrode material is deposited. Subsequently, in the electrode forming step S3, the mask is removed. In this manner, the drive electrodes, in which part of the upper end portions is lower in height than the upper surfaces of the partition walls in the depth direction of the grooves, can be formed on the side surfaces of the partition walls, and at the same time, the extension electrodes can be formed on the upper surfaces of the partition walls.

According to the manufacturing method of the present invention, in the intersection region in which the drive electrodes formed on the partition walls of the actuator substrate intersect the wiring electrodes of the flexible substrate, the upper end portions of the drive electrodes are lower in height than the upper surfaces of the partition walls, and hence the drive electrodes are electrically insulated from the wiring electrodes, with the result that the insulation properties are enhanced. Accordingly, there is no need for a measure to insulate the wiring electrodes 9 from the drive electrodes 7, or even if necessary, a simple method may suffice therefor. Hereinbelow, the method of manufacturing the liquid jet head is described specifically.

(Third Embodiment)

FIGS. 9A to 9F and FIGS. 10A to 10D are schematic cross-sectional views of a liquid jet head 1 for describing a method of manufacturing the liquid jet head 1 according to a third embodiment of the present invention. The same components or components having the same function are represented by the same reference symbols.

Figure 9A:
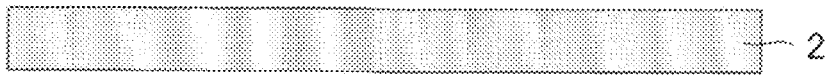
FIGS. 9A, 9B, 9C, 9D, 9E, and 9F are explanatory views illustrating a method of manufacturing a liquid jet head according to a third embodiment of the present invention.
Figure 9B:
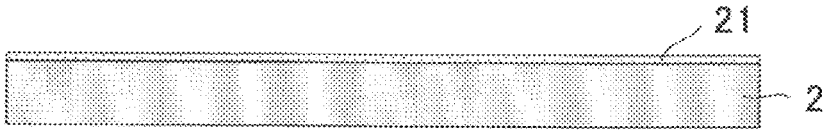

FIGS. 9A and 9B illustrate a substrate preparing step. The actuator substrate 2 formed of a piezoelectric substrate is prepared. A PZT ceramic material subjected to polarization processing in a direction perpendicular to the substrate surface is used as the piezoelectric substrate. FIG. 9B illustrates a state in which a photosensitive resin 21 is applied to the substrate surface of the actuator substrate 2 and is patterned. For example, the photosensitive resin 21 is patterned so that the photosensitive resin 21 is removed in a region in which the extension electrodes are to be formed, and the photosensitive resin 21 is left in a region in which no electrodes are to be formed eventually.

Figure 9C:
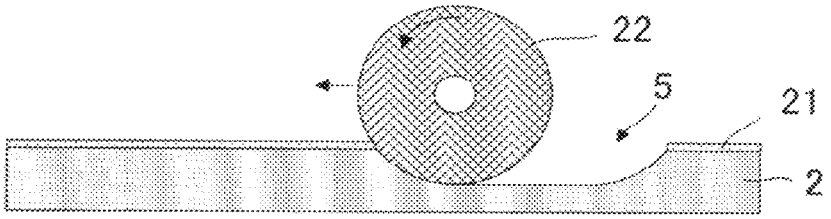
Figure 9D:
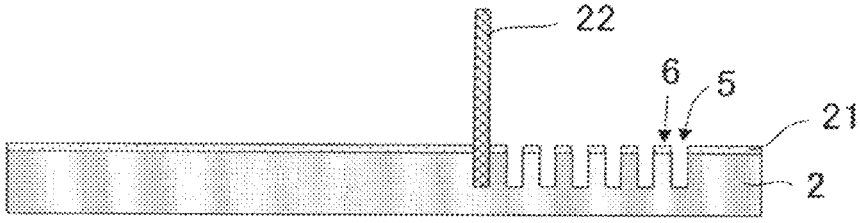

FIGS. 9C and 9D illustrate the groove forming step S1. A dicing blade 22 is used to cut the substrate surface of the actuator substrate 2, to thereby form the grooves 5 in parallel. Adjacent grooves 5 are spaced apart from each another through the intermediation of the partition wall 6. In the case of the liquid jet head 1 of the first embodiment, the grooves 5 for the dummy channels 12 are formed straight over the range from the front end FE to the rear end RE of the actuator substrate 2, while the grooves 5 for the discharge channels 11 are formed over the range from the front end of the actuator substrate 2 to the position short of the rear end RE. In the case of the liquid jet head 1 of the second embodiment, both the grooves 5 for the dummy channels 12 and the grooves 5 for the discharge channels 11 are formed straight over the range from the front end FE to the rear end RE. In this case, the outer shape of the dicing blade 22 is not transferred, and thus the actuator substrate 2 can be formed smaller in width.

Figure 9E:
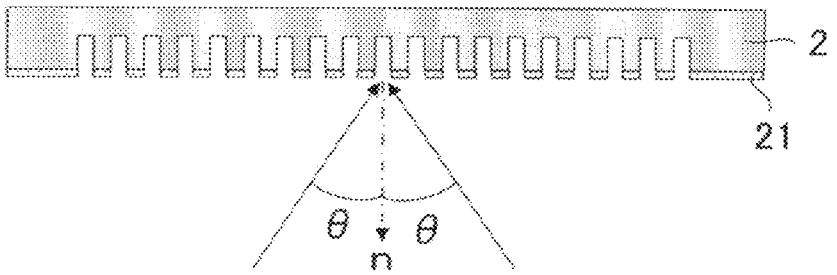
Figure 9F:
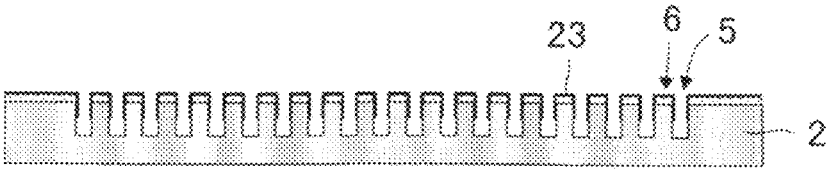

FIGS. 9E and 9F illustrate the electrode depositing step S2. On the substrate surface having the plurality of grooves 5 formed thereon, a conductive material is deposited by an oblique deposition method in directions inclined by angles θ with respect to a vertical direction n. In this manner, on the side surfaces of the partition walls 6 constituting the grooves 5, conductive films 23 can be formed over the range from the points substantially half the depth of the grooves 5 to the upper surfaces of the partition walls 6. As the conductive material, a metallic material such as aluminum, gold, chromium, or titanium may be used. Note that, in this embodiment, part of the substrate surface of the actuator substrate 2 constitutes the upper surfaces of the partition walls 6.

Figure 10A:
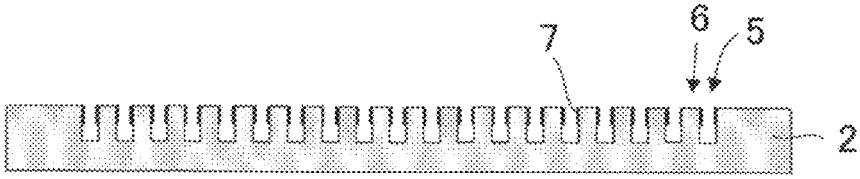
FIGS. 10A, 10B, 10C, and 10D are explanatory views illustrating the method of manufacturing a liquid jet head according to the third embodiment of the present invention.

FIG. 10A illustrates the extension electrode forming step S6. The photosensitive resin 21 that is formed prior to the groove forming step is removed. Accordingly, the conductive films 23 in the region in which the photosensitive resin 21 is formed are removed, while the conductive films 23 in the region in which the photosensitive resin 21 is removed in the groove forming step S1 are left. In this manner, the extension electrodes can be formed on the substrate surface of the actuator substrate 2.

Figure 10B:
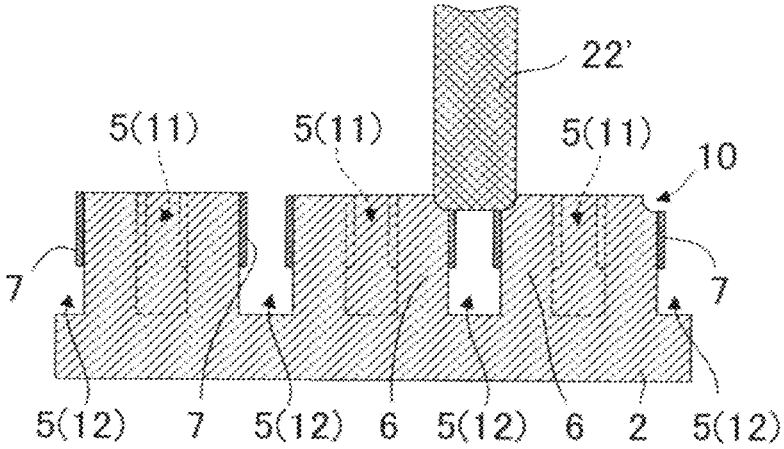

FIG. 10B illustrates the drive electrode forming step S5. In the common wiring intersection region in which the drive electrodes 7 intersect the common wiring electrode formed on the flexible substrate, the corner portions between the side surfaces and the upper surfaces of the two partition walls 6 constituting each dummy channel 12 are cut, to thereby form the chamfer portions 10. The corner portions are chamfered with a dicing blade 22', which is slightly thicker than the width of the groove 5. In this manner, the upper end portions of the drive electrodes 7 can be formed lower in height than the upper surfaces of the partition walls 6 in the depth direction. If the upper end portions of the drive electrodes 7 are cut by 20 μm to 30 μm in the bottom surface direction of the grooves 5 from the position of the upper surfaces of the partition walls 6, even when the common wiring electrode of the flexible substrate is bonded to the upper surfaces of the partition walls 6, the drive electrodes 7 and the common wiring electrode are not electrically short-circuited.

Note that, as the amount of cutting from the upper surfaces of the partition walls 6 becomes larger, the length of the chamfer portions 10 becomes longer. Hence, the region in which the individual extension electrodes 8*b* are formed is also chamfered, with the result that the individual extension electrodes 8*b* are electrically disconnected from the drive electrodes 7. For example, in a case where the dicing blade 22' having a diameter of 2 inches (50.8 mmϕ) is used to form the chamfer portions 10 having a depth of 30 μm, chamfering is performed by an amount of the arc on the outer periphery of the dicing blade 22' over the length of 1.23 mm on one side, and 2.46 mm as a whole. If the chamfer portions 10 having a depth of 100 μm are formed, chamfering is performed by an amount of the arc on the outer periphery of the dicing blade 22' over the length of 2.25 mm on one side, and 4.5 mm as a whole. In other words, the length of the grooves 5 needs to be increased in order to prevent the individual extension electrodes 8*b* from being electrically disconnected from the drive electrodes 7, and accordingly the liquid jet head 1 becomes larger in size. Therefore, the cutting amount (depth in the bottom surface direction from the position of the upper surfaces of the partition walls 6 in the common wiring intersection region CR) that allows a compact liquid jet head 1 to be constructed and prevents the common wiring electrode 9*a* of the flexible substrate 4 and the drive electrodes 7 from being short-circuited may range from 15 μm to 50 μm, preferably from 20 μm to 40 μm, more preferably about 30 μm. Note that, the dicing blade which is thicker than the width of the groove 5 is used to form the chamfer portions 10, but alternatively, for example, the dicing blade used to form the grooves 5 may be used to sequentially chamfer one side surface of the groove 5 and the other side surface thereof.

Figure 10C:
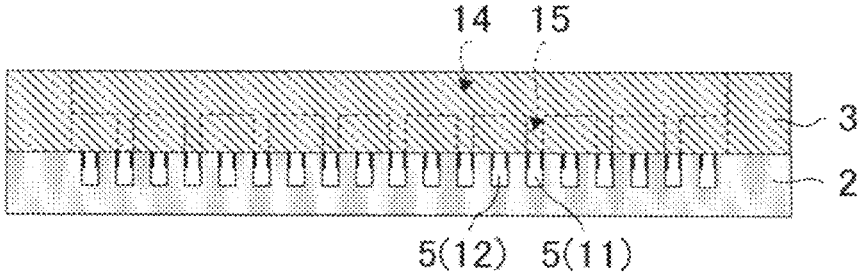

FIG. 10C illustrates a cover plate bonding step of bonding the cover plate 3 to the substrate surface of the actuator substrate 2. The cover plate 3 is bonded with an adhesive so as to close the grooves 5 constituting the discharge channels 11 of the actuator substrate 2 and to expose the common extension electrodes and the individual extension electrodes formed on the substrate surface of the actuator substrate 2 in the vicinity of the rear end RE. The respective slits 15 formed in the lower portion of the liquid supply cell 14 of the cover plate 3 are adapted to communicate to the discharge channels 11, and accordingly the liquid is loadable from the liquid supply cell 14. The dummy channels 12 are closed by the bottom surface of the cover plate 3, and accordingly the liquid is not supplied thereto from the liquid supply cell 14.

Figure 10D:
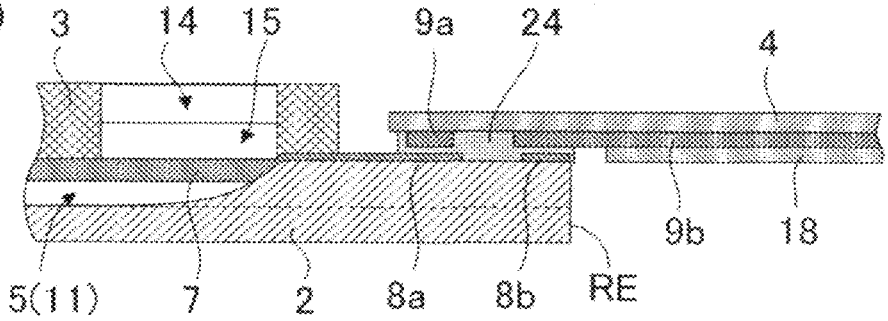

FIG. 10D illustrates the flexible substrate bonding step S4. The flexible substrate 4 having the common wiring electrode 9*a* and the individual wiring electrodes 9*b* formed thereon is bonded to the substrate surface of the actuator substrate 2 in the vicinity of the rear end RE through the intermediation of an anisotropic conductive film 24. In this manner, the common extension electrodes 8*a* and the individual extension electrodes 8*b* on the actuator substrate 2 are electrically connected to the common wiring electrode 9*a* and the individual wiring electrodes 9*b* on the flexible substrate 4 through the anisotropic conductive film 24, respectively. The common extension electrode 8*a* is electrically connected to the drive electrodes 7 formed on both the side surfaces of each discharge channel 11, while the individual extension electrode 8*b* is electrically connected to the drive electrodes on the discharge channel 11 side, which are formed on the side surfaces of both the dummy channels (not shown) adjacent to the discharge channel 11. The cover plate 3 is bonded onto the actuator substrate 2, and the liquid supply cell 14 communicates to the discharge channels 11 through the slits 15. The surfaces of the wiring electrodes 9*a* and 9*b* formed on the flexible substrate 4 are protected by the protection member 18.

In this manner, the common extension electrodes 8*a* corresponding to the respective discharge channels 11 are connected by the common wiring electrode 9*a*, and thus the number of the wiring electrodes on the flexible substrate 4 can be reduced substantially by half as compared to the conventional example. Further, in the common wiring intersection region CR, the upper end portions of the drive electrodes 7 formed on the side surfaces of the grooves 5 are cut, and thus the insulation properties between the drive electrodes 7 and the common wiring electrode 9*a* are enhanced. Accordingly, there is no need for a measure to insulate the wiring electrodes 9 from the drive electrodes 7, or even if necessary, a simple method may suffice therefor. Thus, the flexible substrate 4 can be bonded to the actuator substrate 2 highly easily, thereby enabling reduction in manufacturing cost.

Note that, this embodiment describes the method of manufacturing the liquid jet head 1 which is described in the first embodiment, but the liquid jet head 1 described in the second embodiment can be manufactured in the same manner. In this case, in the groove forming step S1, similarly to the grooves 5 for the dummy channels 12, the grooves 5 for the discharge channels 11 are formed over the range from the front end FE to the rear end RE of the actuator substrate 2. Further, in the drive electrode forming step S5, the chamfer portions 10 are formed in the discharge channels 11 in the individual wiring intersection region SR as well as the chamfer portions 10 are formed in the dummy channels 12 in the common wiring intersection region CR. Further, in the cover plate bonding step, the sealing material 13 is disposed at the end portion of the cover plate 3 on the rear end RE side to prevent the leakage of the liquid from the discharge channels 11.

Further, in this embodiment, the electrodes are patterned by the lift-off method, but the present invention is not limited thereto. The electrodes may be patterned by a photolithography/etching step after the electrodes are formed by an oblique deposition method. Further, in the drive electrode forming step S5, instead of chamfering the corner portions between the side surfaces and the upper surfaces of the partition walls 6 by cutting, only the upper end portions of the drive electrodes 7 may be removed by a laser beam or photolithography and an etching method. Further, in this embodiment, the drive electrode forming step S5 and the extension electrode forming step S6 are carried out independently of each other, but the present invention is not limited thereto. The drive electrode forming step S5 and the extension electrode forming step S6 may be carried out at the same time. For example, the photosensitive resin 21 is not applied in the substrate preparing step, and prior to the electrode depositing step S2, a mask is disposed on the upper end portions of the side surfaces of the partition walls 6 and the upper surfaces of the partition walls 6. After that, in the electrode depositing step S2, the electrode material is deposited. Subsequently, in the electrode forming step S3, the mask is removed. In this manner, the drive electrodes 7, in which part of the upper end portions is lower in height than the upper surfaces of the partition walls 6 in the depth direction of the grooves 5, can be formed on the side surfaces of the partition walls 6, and at the same time, the extension electrodes can be formed on the upper surfaces of the partition walls 6. Thus, there is no need for the step of chamfering the corner portions between the side surfaces and the upper surfaces of the partition walls 6 or the step of additionally removing the electrodes situated in the upper end portions of the side surfaces.

Further, description is given of another method of carrying out the drive electrode forming step S5 and the extension electrode forming step S6 at the same time. For example, after the grooves 5 are formed in the groove forming step S1, the photosensitive resin 21 is softened and caused to flow to the upper end portions of the side surfaces of the partition wall 6. Subsequently, in the electrode depositing step S2, the electrode material is deposited, and then, in the electrode forming step S3, the photosensitive resin 21 is removed. That is, the photosensitive resin 21 situated on the upper surfaces of the partition walls 6 is caused to flow to cover the upper end portions of the partition walls 6, and hence, by removing the photosensitive resin 21, the drive electrodes 7, in which part of the upper end portions is lower in height than the upper surfaces of the partition walls 6 in the depth direction of the grooves 5, are formed. Thus, the drive electrodes 7 can be formed on the side surfaces of the partition wall 6, and at the same time, the extension electrodes can be formed on the upper surfaces of the partition walls 6. As a result, there is no need for the step of chamfering the corner portions between the side surfaces and the upper surfaces of the partition walls 6 or the step of additionally removing the electrodes situated in the upper end portions of the side surfaces. Note that, in the above-mentioned lift-off method in which the electrode pattern is formed by depositing the electrode material after the photosensitive resin 21 is patterned, and then removing the photosensitive resin 21, the photosensitive resin 21 functions as the mask.

<Liquid Jet Apparatus>

(Fourth Embodiment)

Figure 11:
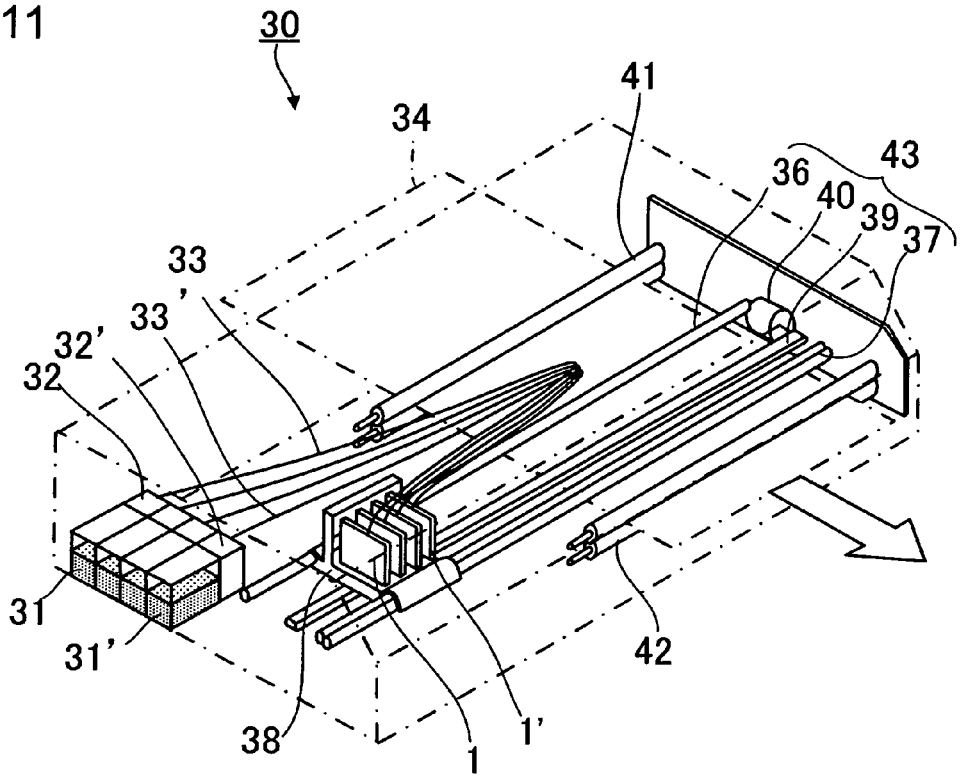
FIG. 11 is a schematic perspective view of a liquid jet apparatus according to a fourth embodiment of the present invention.
Figure 12:
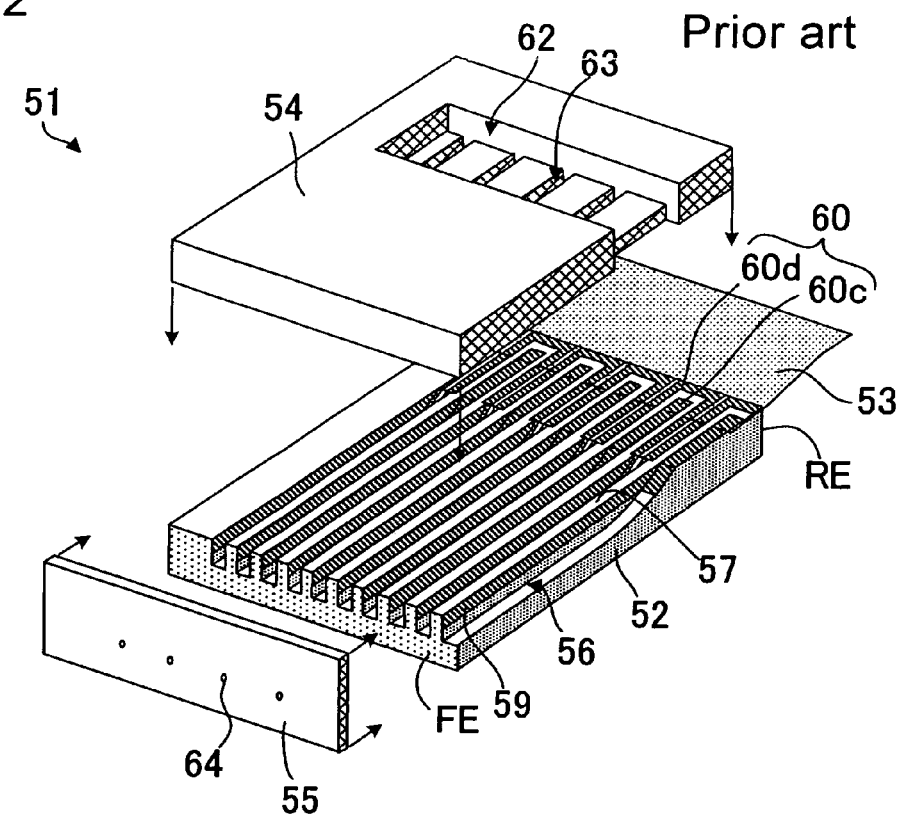
FIG. 12 is an exploded perspective view of a conventionally known liquid jet head.
Figure 13:
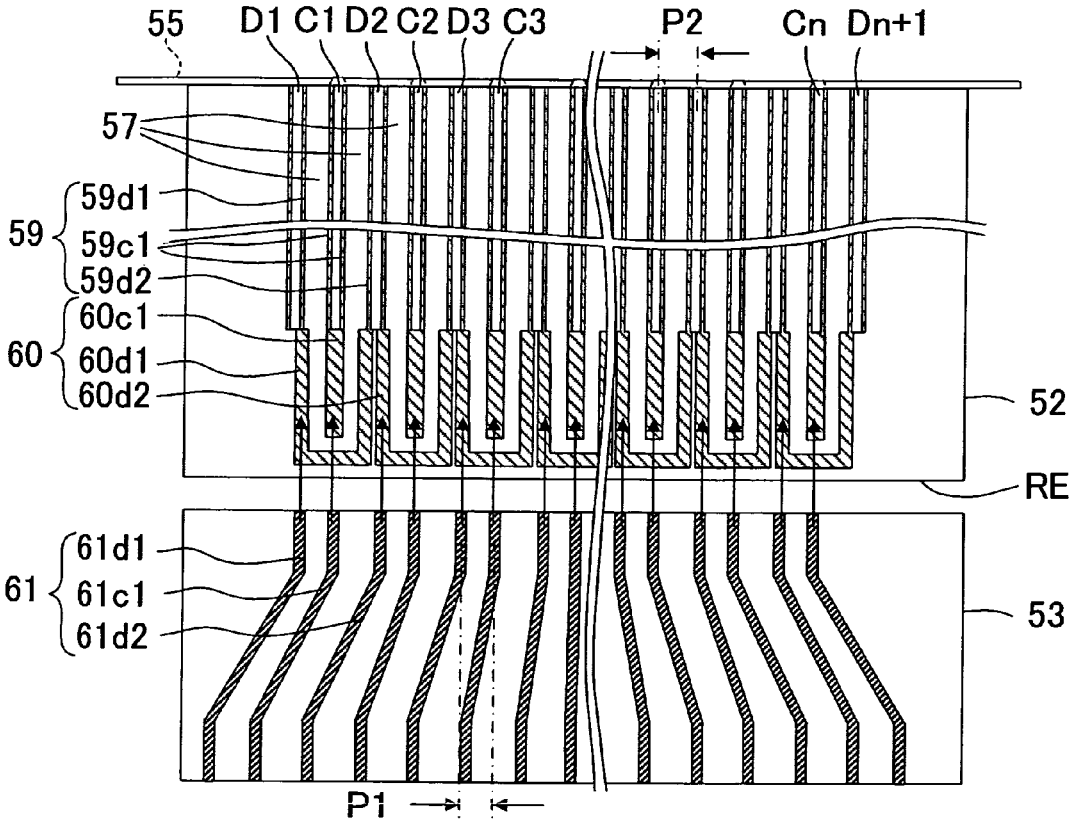
Fig.13 Prior art
FIG. 13 is a schematic top view of a conventionally known piezoelectric substrate and a conventionally known flexible substrate.
Figure 14:
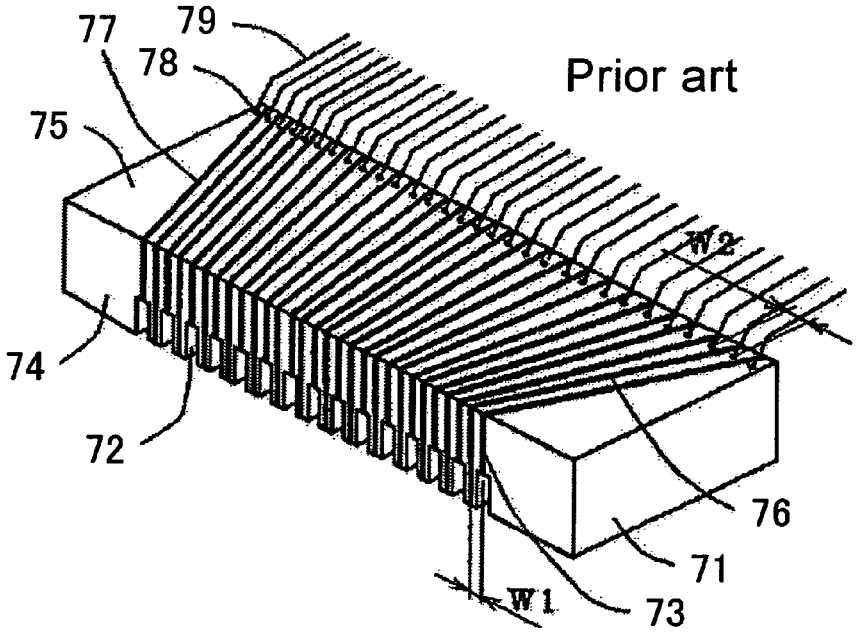
FIG. 14 is a schematic view of a conventionally known ink jet head.

FIG. 11 is a schematic perspective view of a liquid jet apparatus 30 according to a fourth embodiment of the present invention.

The liquid jet apparatus 30 includes a moving mechanism 43 for reciprocating liquid jet heads 1 and 1' according to the present invention described above, liquid supply tubes 33 and 33' for supplying liquid to the liquid jet heads 1 and 1', respectively, and liquid tanks 31 and 31' for supplying the liquid to the liquid supply tubes 33 and 33', respectively. The liquid jet heads 1 and 1' are each constituted by the liquid jet head 1 according to the present invention. Specifically, the liquid jet heads 1 and 1' each include: an actuator substrate having a plurality of grooves arranged in parallel in a substrate surface thereof and partition walls each for spacing adjacent grooves apart from each other; a cover plate covering the grooves and bonded to a substrate surface of the actuator substrate; and a nozzle plate including nozzles communicating to the grooves and bonded to an end surface of the actuator substrate. The actuator substrate includes discharge channels for discharging liquid droplets and dummy channels that do not discharge liquid droplets, the discharge channels and the dummy channels being arranged alternately with each other. On the substrate surface of the actuator substrate in the vicinity of the rear end, common extension electrodes and individual extension electrodes are arranged. The common extension electrode is connected to drive electrodes formed on side surfaces of the discharge channel, and the individual extension electrode is connected to drive electrodes formed on side surfaces of the dummy channels on the discharge channel side. The common extension electrode is situated closer to the front end than the individual extension electrode. On the flexible substrate, a common wiring electrode and individual wiring electrodes are arranged. The common wiring electrode is electrically connected to the common extension electrodes, and the individual wiring electrodes are electrically connected to the individual extension electrodes.

Specific description is given below. The liquid jet apparatus 30 includes: a pair of transport means 41 and 42 for transporting a recording medium 34 such as paper in a main scanning direction; the liquid jet heads 1 and 1' for discharging liquid onto the recording medium 34; pumps 32 and 32' for pressing the liquid stored in the liquid tanks 31 and 31' to supply the liquid to the liquid supply tubes 33 and 33', respectively; and the moving mechanism 43 for moving the liquid jet heads 1 and 1' to perform scanning in a sub-scanning direction orthogonal to the main scanning direction.

The pair of transport means 41 and 42 each extend in the sub-scanning direction, and include a grid roller and a pinch roller that rotate with their roller surfaces coming into contact with each other. The grid roller and the pinch roller are rotated about their shafts by means of a motor (not shown) to transport the recording medium 34 sandwiched between the rollers in the main scanning direction. The moving mechanism 43 includes a pair of guide rails 36 and 37 extending in the sub-scanning direction, a carriage unit 38 capable of sliding along the pair of guide rails 36 and 37, an endless belt 39 to which the carriage unit 38 is connected and thereby moved in the sub-scanning direction, and a motor 40 for revolving the endless belt 39 through pulleys (not shown).

The carriage unit 38 has the plurality of liquid jet heads 1 and 1' placed thereon, and discharges four kinds of liquid droplets, such as yellow, magenta, cyan, and black. The liquid tanks 31 and 31' store liquid of corresponding colors, and supply the liquid through the pumps 32 and 32' and the liquid supply tubes 33 and 33' to the liquid jet heads 1 and 1', respectively. The liquid jet heads 1 and 1' discharge the liquid droplets of the respective colors in response to a drive signal. By controlling the timing to discharge the liquid from the liquid jet heads 1 and 1', the rotation of the motor 40 for driving the carriage unit 38, and the transport speed of the recording medium 34, an arbitrary pattern can be recorded on the recording medium 34.

With this structure, the number of wiring electrodes on the flexible substrate can be reduced as compared to the number of electrode terminals on the actuator substrate, and the wiring density can be halved substantially. Further, in the region in which the drive electrodes 7 formed in the grooves 5 intersect the wiring electrodes of the flexible substrate 4, the upper end portions of the drive electrodes 7 are formed deeper than the upper surfaces of the partition walls 6, and hence the wiring electrodes of the flexible substrate 4 are not brought into electric contact with the drive electrodes 7 formed in the grooves 5. As a result, the flexible substrate 4 is easily bonded to the actuator substrate 2, thereby enabling increase in manufacturing yields.

What is claimed is:

1. A liquid jet head, comprising:

an actuator substrate comprising:

a plurality of grooves, which are elongated in a direction from a front end of a substrate surface to a rear end thereof, and arranged in a direction intersecting the direction from the front end to the rear end while being spaced apart from one another through an intermediation of partition walls;

drive electrodes, which are formed on side surfaces of each of the partition walls; and extension electrodes, which are electrically connected to the drive electrodes and formed on the substrate surface in the vicinity of the rear end;

a cover plate, which is bonded to the substrate surface and closes upper openings of the plurality of grooves to form a plurality of channels; and a flexible substrate, which is bonded to the substrate surface in the vicinity of the rear end, and comprises wiring electrodes electrically connected to the extension electrodes, wherein the plurality of channels comprise:

a discharge channel for discharging liquid; and a dummy channel that does not discharge the liquid, the discharge channel and the dummy channel being arranged alternately with each other, wherein the plurality of grooves comprise a groove constituting the dummy channel, which extends to the rear end of the actuator substrate, wherein the extension electrodes comprise:

an individual extension electrode, which is formed on the substrate surface in the vicinity of the rear end between two dummy channels adjacent to both sides of the discharge channel, and electrically connected to drive electrodes formed on side surfaces of the two dummy channels on the discharge channel side; and a common extension electrode, which is formed on the substrate surface in the vicinity of the rear end and closer to the front end than the individual extension electrode, and electrically connected to drive electrodes formed on two side surfaces of the discharge channel, wherein the wiring electrodes comprise:

a common wiring electrode, which electrically connects the common extension electrode corresponding to the discharge channel, and another common extension electrode corresponding to another discharge channel; and a plurality of individual wiring electrodes, which are electrically and individually connected to the individual extension electrode corresponding to the discharge channel and another individual extension electrode corresponding to the another discharge channel, and wherein, in a common wiring intersection region in which the common wiring electrode intersects the drive electrodes, upper end portions of drive electrodes formed on side surfaces of the groove constituting the dummy channel are formed deeper in a depth direction of the groove than the substrate surface.

2. A liquid jet head according to claim 1, wherein, in the common wiring intersection region, corner portions between the substrate surface and the side surfaces of the groove constituting the dummy channel are cut in the depth direction.

3. A liquid jet head according to claim 1, wherein the plurality of grooves comprise a groove constituting the discharge channel, which extends from the front end of the actuator substrate to a position short of the rear end.

4. A liquid jet head according to claim 1, wherein the plurality of grooves comprise a groove constituting the discharge channel, which extends from the front end of the actuator substrate to the rear end thereof, wherein the individual extension electrode comprises:

a first individual extension electrode, which is formed between the discharge channel and a dummy channel adjacent to one side of the discharge channel; and a second individual extension electrode, which is formed between the discharge channel and a dummy channel adjacent to another side of the discharge channel, wherein the first individual extension electrode is electrically connected to a drive electrode formed on a side surface of the dummy channel adjacent to the one side of the discharge channel, the side surface being situated on the discharge channel side, and the second individual extension electrode is electrically connected to a drive electrode formed on a side surface of the dummy channel adjacent to the another side of the discharge channel, the side surface being situated on the discharge channel side, wherein the common extension electrode comprises:

a first common extension electrode, which is formed between the discharge channel and the dummy channel adjacent to the one side of the discharge channel; and a second common extension electrode, which is formed between the discharge channel and the dummy channel adjacent to the another side of the discharge channel, wherein the first common extension electrode is electrically connected to a drive electrode formed on one side surface of the groove constituting the discharge channel, and the second common extension electrode is electrically connected to a drive electrode formed on another side surface of the groove constituting the discharge channel, and wherein the common wiring electrode electrically connects the first common extension electrode and the second common extension electrode that correspond to the discharge channel.

5. A liquid jet head according to claim 4, wherein one of the plurality of individual wiring electrodes electrically connects the first individual extension electrode and the second individual extension electrode that correspond to the discharge channel.

6. A liquid jet head according to claim 5, wherein, in an individual wiring intersection region in which the plurality of individual wiring electrodes intersect the drive electrodes, upper end portions of the drive electrodes formed on the one side surface and the another side surface of the groove constituting the discharge channel are formed deeper in the depth direction of the groove than the substrate surface.

7. A liquid jet head according to claim 6, wherein, in the individual wiring intersection region, corner portions between the substrate surface and the one side surface of the groove constituting the discharge channel and between the substrate surface and the another side surface of the groove constituting the discharge channel are cut in the depth direction.

8. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

* * * * *